United States Patent [19]

Yuguchi

[11] Patent Number: 4,685,493

[45] Date of Patent: Aug. 11, 1987

[54] REINFORCING BAR BINDING DEVICE

[76] Inventor: Sadao Yuguchi, 4-36, Honda 1-chome, Nishi-ku, Osaka-shi, Osaka, Japan

[21] Appl. No.: 815,108

[22] Filed: Dec. 31, 1985

[30] Foreign Application Priority Data

Feb. 18, 1985 [JP] Japan ..... 60-29939

[51] Int. Cl.[4] ..... B21F 15/04

[52] U.S. Cl. ..... 140/119; 140/57; 140/93 A

[58] Field of Search ..... 140/49, 57, 93.6, 119, 140/93 A, 93.2

[56] References Cited

U.S. PATENT DOCUMENTS

| | | | |
|---|---|---|---|
| 3,323,558 | 6/1967 | Collins | 140/93.6 |
| 3,391,715 | 7/1968 | Thompson | 140/93.6 |
| 3,633,633 | 1/1972 | Countryman | 140/93.2 |
| 4,117,872 | 10/1978 | Gott et al. | 140/93.6 |
| 4,354,535 | 10/1982 | Powell et al. | 140/119 |
| 4,362,192 | 12/1982 | Furlong et al. | 140/119 |

*Primary Examiner*—Lowell A. Larson

*Attorney, Agent, or Firm*—Armstrong, Nikaido, Marmelstein & Kubovcik

[57] ABSTRACT

A portable reinforcing bar binding device used in reinforced concrete casting sites for automatically binding reinforcing bars at their intersections with a length of wire, wherein mounted on a handle-equipped frame are a feed reel for a steel wire to be used as a binding wire, a steel wire delivery mechanism disposed in the path of withdrawal of the steel wire from the feed reel, a steel wire loop forming mechanism disposed at the terminal end of the path of withdrawal of steel wire and adapted to be advanced and retracted by a driving unit, a steel wire cutting mechanism whose region of engagement with the steel wire is positioned between the steel wire loop forming mechanism and the terminal end of the path of withdrawal of steel wire, and a steel wire twisting mechanism.

7 Claims, 5 Drawing Figures

REINFORCING BAR BINDING DEVICE

BACKGROUND OF THE INVENTION

1. Field of the Invention

The present invention relates to a reinforcing bar binding device and more particularly to a portable reinforcing bar binding device used in reinforced concrete casting sites for winding a binding steel wire around column reinforcements, beam reinforcements, threaded dowel reinforcements or wall reinforcements at their intersections.

2. Prior Art

In constructing reinforced concrete structures such as buildings and bridge piers, various binding tools or devices including hookers and Hotchkiss type reinforcing bar binding devices for winding a binding steel wire around column reinforcements, beam reinforcements, threaded dowel reinforcements, wall reinforcements or other reinforcing bars at their intesections. For example, in the case of using a hooker, an annealed steel wire is folded double and wound around reinforcing bars at their intersection to form a loop of steel wire which is then hooked by the hooker and twisted to thereby bind the reinforcing bars at their intersection.

When reinforcing bars are to be bound at their intersection by a manual binding tool, for example, a hooker, as described above, all operations from the double-folding of steel wire to the twisting of wire subsequent to winding are performed through the operator's experience and sixth sense; thus, when there are differences in the hardness and thickness of steel wires, it is almost impossible in practice to expect to maintain at a fixed level the binding strength at intersections, resulting in adverse effects on the strength and dimensional accuracy of reinforced concrete structures. Further, reinforced concrete casting operations using such manual binding tool are generally low in operating efficiency, with the result that the saving of construction cost is limited. Further, the Hotchkiss type reinforcing bar binding device has a drawback in practice that the binding strength on reinforcing bars is insufficient because of structural limitations, and the cost of the device greatly limits the application of the device.

SUMMARY OF THE INVENTION

The present invention has for its main object the provision of an automatic binding device capable of eliminating the aforesaid disadvantages found in steel wire binding tools or binding devices conventionally used in reinforced concrete casting cites.

Another important object of the present invention is to provide a reinforcing bar binding device which is superior in simplicity of construction and in reliability of operation and suitable for labor-saving in construction sites.

With the above objects in mind, the present invention is a portable binding device used in reinforced conrete casting sites for automatically binding reinforcing bars at their intersection with a length of binding wire, such as an annealed steel wire, wherein mounted on a frame with a handle are a feed reel for a binding wire, a wire delivery mechanism disposed in the path of withdrawal of the wire from the feed reel, a wire loop forming mechanism disposed at the terminal end of the path of withdrawal of the wire and adapted to be advanced and retracted by a driving unit, a wire cutting mechanism whose region of engagement with the wire is positioned between the wire loop forming mechanism and the terminal end of the path of withdrawal of the wire, and a wire twisting mechanism.

By using the present inventive device, reinforcing bars are automatically bound at their intersections by binding wires. Further, according to the present inventive device, since the intersection of reinforcing bars is clamped rapidly and accurately under the action of a preset clamp pressure, remarkable effects can be attained in respect of labor-saving in reinforced concrete casting sites and reduction of cost of construction of reinforced concrete structures.

DESCRIPTION OF THE PREFERRED EMBODIMENT

Figure 1:
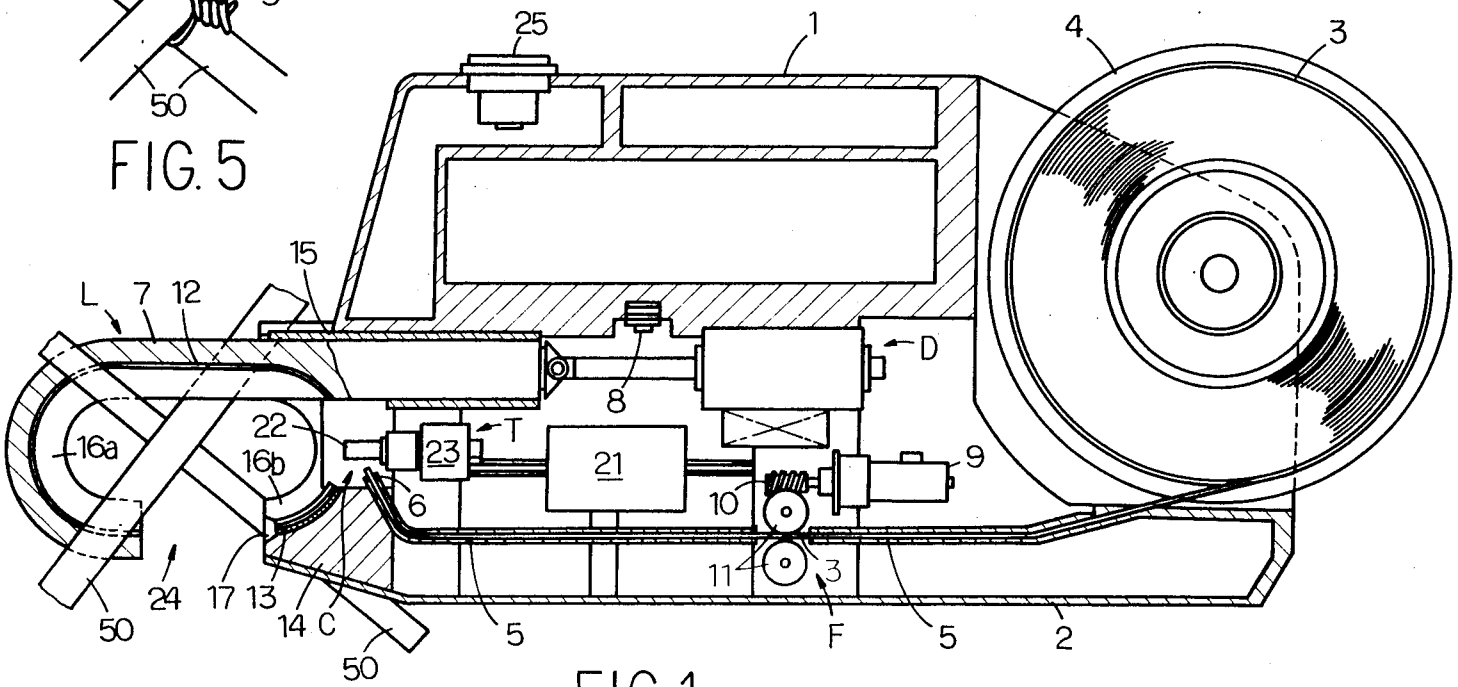
FIG. 1 is a longitudinal sectional view illustrating the device embodying the present invention.
Figure 5:
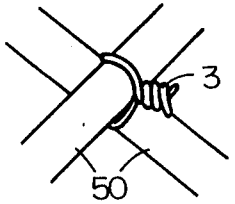
FIG. 5 is a perspective view of an intersection of reinforcing bars bound with a wire.

As seen in FIG. 1, the present inventive device, designed to serve as a portable binding device for winding a binding wire such as an annealed steel wire 3 around reinforcing bars 50 at their intersection and fixing the wire thereat (FIG. 5), is characterized in that mounted on a frame 2 having a handle 1 and a start pushbutton switch 25 are a feed reel 4 for the steel wire 3, a steel wire delivery mechanism F, a steel wire loop forming mechanism L, a steel wire cutting mechanism C and a steel wire twisting mechanism T, these components being started and stopped as desired.

The steel wire delivery mechanism F comprises a motor 9 adapted to be started by pushing a microswitch 8 installed in the path of movement of a movable member 7 forming the steel loop forming mechanism L to be later described, and a pair of feed rollers 11 adapted to be rotated by a worm 10 connected to the rotary shaft of the motor 9 and a companion worm gear (not shown) on a feed roller shaft for delivering the steel wire 3 unwound from the feed reel 4 along a path of withdrawal 5. The motor 9 may be a known stepping motor, pulse motor, ac motor or any other motor provided that it has the step-feed function of delivering preset lengths of steel wire 3.

Figure 2:
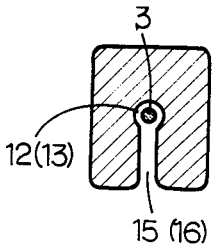
FIG. 2 is a view schematically illustrating an exemplary construction of a wire cutting mechanism.
Figure 4:
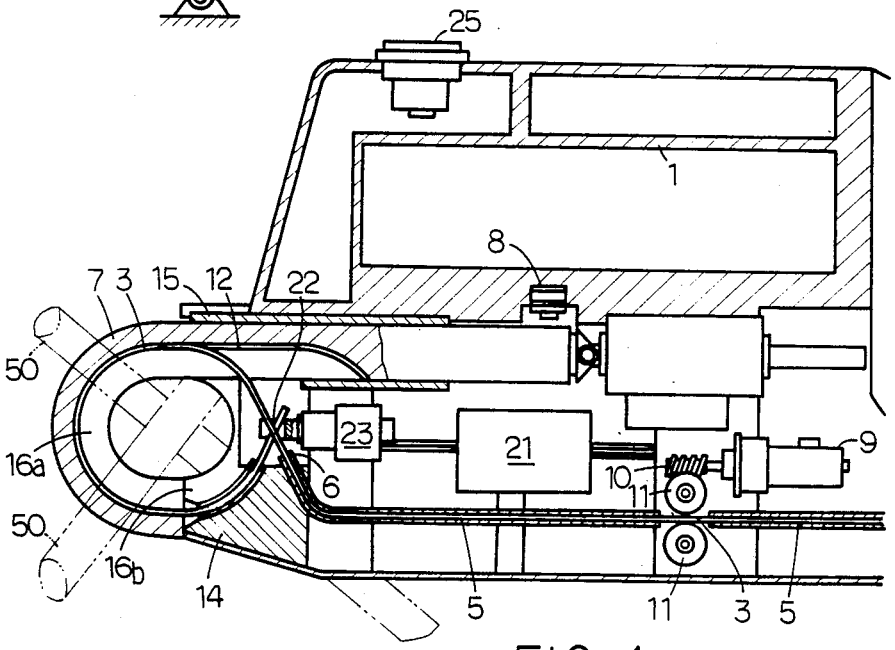
FIG. 4 is a view similar to FIG. 1, with the movable member retracted.

The steel loop forming mechanism L comprises a substantially J-shaped movable member 7 connected to a reciprocating type driving unit D such as a solenoid or hydraulic cylinder mechanism and supported in a lengthwise displaceable manner in a plain bearing 15 which in turn is mounted in the frame, and a stationary member 14 having an arcuate steel wire insertion passage 13 communicating with a loop-shaped steel wire insertion passage 12 formed in the movable member 7. In the illustrated embodiment, a 10-kg output, 30-mm stroke solenoid serving as the reciprocating type driving unit D is operatively connected to the movable member 7, and an unillustrated compression spring installed adjacent the plain bearing 15 constantly urges the movable member to advance, whereby an insertion gap 24 for the reinforcing bars 50 is defined between the movable and stationary members 7 and 14. The movable and stationary members 7 and 14 are provided with slits 16*a* and 16*b* extending inwardly from the steel wire insertion passages 12 and 13 to serve as a diameter-reducing route for the steel wire 3, as shown in FIG. 2, so as to wind the steel wire 3 around the reinforcing bars 50 at their intersection. In addition, the end of the passage 13 in the stationary member 14 is formed with a port 17 which conically opens toward the end surface for facilitating the entry of the steel wire 3 from the passage 12 in the movable member 7.

Figure 3:
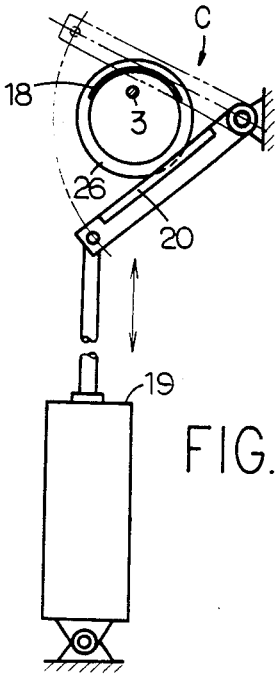
FIG. 3 is a cross-sectional view showing the shape of slits formed in movable and stationary members.

On the other hand, the steel wire cutting mechanism C, whose construction is schematically shown in FIG. 3, is disposed between the steel wire loop forming mechanism L and the terminal end 6 of the path of withdrawal 5 of the steel wire 3, while the steel wire twisting mechanism T is disposed adjacent the steel wire cutting mechanism.

Referring to FIG. 3, the steel wire cutting mechanism C comprises a cylindrical guide member 26 for receiving the steel wire 3, a fixed cutting blade 18 mounted on the end wall surface of the guide member, and a movable cutting blade 20 connected to a driving unit 19 such as a solenoid for forward and backward movement relative to the fixed cutting blade 18 so that it engages the latter. The steel wire cutting mechanism C is connected to a control circuit having a sensor 21 adapted to detect that the steel wire delivery end surface, or the hooked end surface of the J, of the movable member 7 abuts against the steel wire reception end surface of the stationary member 14 to establish the communication between the steel wire insertion passages 12 and 13 through the port 17. Alternative cutting arrangement, such as a rotary cutter, may be used.

The steel wire twisting mechanism T comprises a motor 23 having a twister 22 adapted to be started simultaneously with the stoppage of the driving unit T or the deenergization of a solenoid so as to twist one end of a length of steel wire 3 withdrawn from the terminal end 6 of the path of withdrawal 5 and cut by the steel wire cutting mechanism C together with the other end of the steel wire length which is delivered from the steel wire insertion passage 13 in such a manner as to intersect said one end. The number of revolutions and the stop position of the motor 23 is so controlled by the control circuit that the motor stops its rotation after the intersection has been twisted a predetermined number of turns while forming a communication passage for the subsequent steel wire 3 between the path of withdrawal 15 and the steel wire insertion passages 12, 13 through the twister 22.

The operating sequence of the device will now be described.

(1) The intersection of the reinforcing bars 50 is passed through the insertion gap 24 defined between the movable and stationary members 7 and 14 to enter the space surrounded by these members.

(2) The operator pushes the start pushbutton switch 25 to energize the solenoid forming the reciprocating type driving unit D which then retracts the movable member 7 until its steel wire delivery end surface abuts against the steel wire reception end surface of the stationary member 14.

(3) The movable member 7 pushes the microswitch 8 on its return stroke to thereby energize the motor 9 through a relay (not shown) incorporated in the control circuit. Thus, the steel wire 3 wound on the feed reel 4 is withdrawn into the path of withdrawal 5 by the rotation of the feed rollers 11 and travels fromthe terminal end 6 of the path of withdrawal through the steel wire cutting mechanism C, twister 22 and steel wire insertion passages 12 and 13 communicating with each other and back to the twister 22, where it intersects itself. Simultaneously therewith, the intersection of the reinforcing bars 50 is surrounded by the diameter-reduced loop of the steel wire 3. As soon as the front end of the steel wire 3 projects beyond the end of the twister 22, as shown in FIG. 1, the motor 9 is stopped.

(4) When the communication between the steel wire insertion passages 12 and 13 is detected by the sensor 21, the solenoid 19 of the steel wire cutting mechanism C is energized, whereby the fixed cutting blade 18 mounted on the end surface of the guide member 26 and the movable cutting blade 20 connected to the solenoid 19 engage each other to cut the steel wire 3 between the twister 22 and the terminal end 6 of the path of withdrawal 5.

(5) With the deenergization of the solenoid 19, the motor 23 of the steel wire twisting mechanism T is started through the control circuit so that the intersection of the steel wire 3 formed on the twister 22 is twisted a predetermined number of turns. Thus, the intersection of the reinforcing bars 50 is firmly clamped by the loop of the steel wire 3 further reduced in diameter by the twisting operation to thereby attain a bound state suitable for the subsequent casting of concrete.

(6) As soon as the rotation of the motor 23 is stopped, the solenoid of the reciprocating type driving unit D is deenergized through the control circuit, so that the movable member 7 is advanced away from the stationary member 14 under the action of the compression spring to restore the insertion gap for the reinforcing bars 50, thus making ready for the subsequent reinforcing bar binding operation. Thereafter, the operation of binding the reinforcing bars is repeated according to the aforesaid operating sequence, enabling the construction of the reinforced concrete structure to proceed.

As can be understood from the foregoing description, the use of the present inventive device makes it possible to rapidly and firmly bind reinforcing bars at their intersections under a predetermined clamping pressure using a steel wire. According to the invention, since the reinforcing bar binding operation can be carried out in a fully automatic manner, the invention exhibits remarkable effects in reducing labor and cost involved in reinforced concrete casting operation.

What is claimed is:

1. A portable device for binding reinforcing bars at an intersection thereof with a length of binding wire, comprising:

a frame with a handle;

a feed reel of binding wire detachably mounted on said frame adjacent one end of said frame;

a wire loop forming mechanism mounted on said frame adjacent the other end of said frame, said loop forming mechanism having a J-shaped movable member displacable lengthwise of said frame for protruding the free end of said movable member from said other end of said frame and forming a hook between said protruding free end and said frame;

drive means for displacing said movable member to protrude said member and forming said hook and for retracting said movable members;

a wire path for withdrawing wire from said feed reel extending lengthwise of said frame and around the inner surface of said J-shaped movable member and back into said frame when said movable member is retracted;

a wire delivery mechanism disposed in said path of withdrawal of wire in said frame for feeding said wire along said path;

a wire twisting mechanism disposed in said other end of said frame at the end of said wire path back into said frame; and a wire cutting mechanism disposed ins aid frame inwardly in said frame of said wire twisting mechanism.

2. A device as set forth in claim 1, wherein the column of said J-shaped movable member is mounted in said frame in a lengthwise displacable manner, and a solenoid for displacing and retracting said J-shaped movable member is mounted in said frame, hooked end of said J-shaped movable member being spaced apart from the opposing end face of said face to thereby allow the reinforcing bar to be received between said hooked end of said J-shaped movable members and said frame.

3. A device as set forth in claim 2, wherein said wire path in said J-shaped movable member opens at one end thereof at the hooked end face thereof, and said stationary member has an arcuate wire passage opening at one end at the end face opposing to said hooked end face of said J-shaped movable member in alignment with the end of said wire path in said movable member, the other end of said arcuate wire passage extending toward but terminating at a distance short of said wire twisting mechanism.

4. A device as set forth in claim 3, wherein said wire path in said J-shaped movable members opens by way of slits through which a wire passes, after said wire loop is formed and siad wire is twisted around the reinforcing bars.

5. A device as set forth in claim 1, wherein said wire delivery mechanism includes a pair of feed rollers opposing each other across the wire being fed, and a drive means for intermittently turning said feed rollers.

6. A device as set forth in claim 1, wherein said wire twisting mechanism includes a twister with a recess for receiving the wire at its intersection and a drive means for turning said twister a desired member of turns.

7. A device as set forth in claim 1, wherein said wire cutting device includes a cylindrical guide member for guiding the wire to be cut, a stationary blade provided in an inner end surface of the guide member, a movable blade for cooperative engagement with the stationary blade, and a drive means for reciprocating said movable blade.

* * * * *